United States Patent [19]

Woffendin

[11] Patent Number: 4,510,635

[45] Date of Patent: Apr. 16, 1985

[54] BOX SPRING ASSEMBLIES

[75] Inventor: Arnold Woffendin, Colne, England

[73] Assignee: Silentnight Holdings PLC, Lancashire, United Kingdom

[21] Appl. No.: 504,371

[22] Filed: Jun. 14, 1983

[30] Foreign Application Priority Data

Jun. 18, 1982 [GB] United Kingdom ..... 8217733
Apr. 9, 1983 [GB] United Kingdom ..... 8309711

[51] Int. Cl.[3] ..... A47C 23/02; A47C 23/00; F16F 3/00

[52] U.S. Cl. ..... 5/247; 5/255; 5/269; 267/103; 267/110

[58] Field of Search ..... 5/267, 247, 255, 260, 5/268, 269, 251; 267/103, 110, 91

[56] References Cited

U.S. PATENT DOCUMENTS

| | | | |
|---|---|---|---|
| 584,922 | 6/1897 | Cochrane | 5/255 |
| 2,454,965 | 11/1948 | Elder | 5/247 |
| 3,242,505 | 3/1966 | Tyhanic | 5/267 |
| 3,911,511 | 10/1975 | Higgins et al. | 5/255 |
| 4,068,329 | 1/1978 | Gross et al. | 5/255 |
| 4,238,861 | 12/1980 | Mizelle | 5/255 |
| 4,339,834 | 7/1982 | Mizelle | 5/255 |

*Primary Examiner*—Alexander Grosz
*Assistant Examiner*—Vinh Luong
*Attorney, Agent, or Firm*—Woodward, Weikart, Emhardt & Naughton

[57] ABSTRACT

A box spring assembly has an array of vertical springs attached to a horizontal foundation and supporting a deck or platform for receiving a bedding load, i.e. a mattress and its occupant(s). The assembly has a plurality of deck elements each formed from a single length of wire with an elongate central section terminating in curved sections extending at least in some elements into spring legs. The deck elements are arranged in parallel lengthwise rows with adjacent elements of each row having aligned central sections. Adjacent curved sections are secured to each other and to adjacent rows by transverse helical connecting elements. The central sections of the spring elements and the transverse helical connecting elements together form the deck for receiving the bedding load. This deck is supported by the spring legs which are secured at their lower ends to the foundation.

9 Claims, 9 Drawing Figures

BOX SPRING ASSEMBLIES

This invention relates to box spring assemblies and, more particularly, to a box spring assembly of the kind in which an array of vertical springs attached to a horizontal foundation supports a deck or platform for receiving a bedding load, i.e. a mattress and its occupant(s).

Such box spring assemblies find their principal application in the manufacture of divan bed bases.

It is known to manufacture a spring assembly for sprung edge divans using the same automatic techniques as are used for making a mattress spring unit. Thus, successive rows of double-cone coil springs are united by helical wire connectors (known as "helicals") to form a Bonnell or open-type spring unit. Each helical interconnects the springs of two adjacent rows by encircling the large end coils which are juxtaposed on the line of travel of the helical. By using top and bottom helicals simultaneously each row of springs is rapidly and securely united with its predecessors.

The use of such a spring assembly for a divan bed base has disadvantages because of the construction of the horizontal foundation. This comprises a rectangular frame, generally made of timber, having parallel longitudinal side rails interconnected by end rails at the head and foot ends and by cross rails which are spaced apart at regular intervals between said ends. If the spring array attached to this foundation is constructed as a Bonnell spring unit many of the springs will not rest on the rails, which may lead to unacceptable sagging of the spring assembly between the cross rails.

Many attempts have been made to improve the construction of divan bed bases by using box spring assemblies, in particular by using non-coil springs. A recent design is described in U.K. patent application No. 2 072 500A by Hoover Universal Inc. which also contains references to the pre-existing patent literature.

A disadvantage of non-coil spring box spring assemblies is that hitherto a variety of different components has been used in their construction which therefore entails a considerable amount of manual labour. For example, the main embodiment of Application No. 2 072 500A includes a rectangular wire grid that forms a mattress support deck positioned above the foundation frame and a plurality of wire springs that are mounted on the cross rails and connected to the deck so as to yieldably resist downwardly directed bedding loads. Instead of the clips previously used to secure the springs to the deck, Application No. 2 072 500A provides a spring which clamps onto the deck utilizing the resilience in the deck and spring wires to maintain the clamp. While this is clearly an improvement, full automation of the manufacture of the box spring assembly described in Application No. 2 072 500A is still difficult because of the need to affix the springs to the wire deck.

A further difficulty in the manufacture of box spring assemblies such as described in Application No. 2 072 500A is the attachment of the feet of the springs to the cross rails of the frame. In said Application the feet are stapled to the top sides of the cross rails but problems are caused by the relative inaccessibility of the stapling locations.

It is an object of the present invention to provide a box spring assembly in which the above disadvantages are obviated or mitigated.

According to the present invention there is provided a box spring assembly of the kind defined comprising a plurality of deck elements each formed from a single length of wire having an elongate central section terminating in curved sections extending at least in some elements into spring legs, the deck elements being arranged in parallel lengthwise rows with adjacent elements of each row having aligned central sections and adjacent curved sections being secured to each other and to adjacent rows by transverse helical connecting elements, whereby the central sections of the spring elements and the transverse helical connecting elements together form the deck for receiving the bedding load, the deck being supported by the spring legs which are secured at their lower ends to the foundation.

The invention will now be described by way of example only, with reference to the accompanying drawings, in which.

Figures 1, 3:
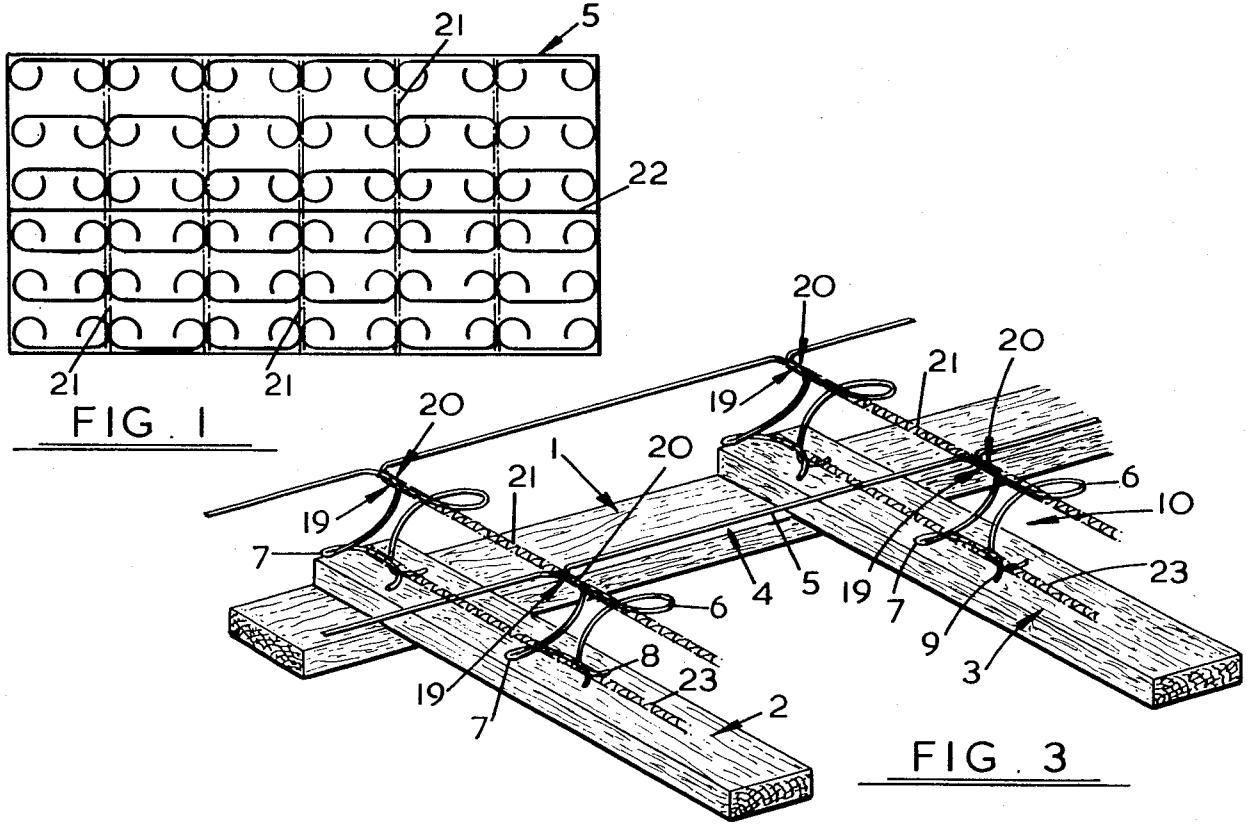
FIG. 1 is a diagrammatic plan view of the deck part of a box spring assembly according to the invention.
FIG. 3 is a view corresponding to FIG. 2 of a second embodiment of such a box spring assembly.
Figure 2:
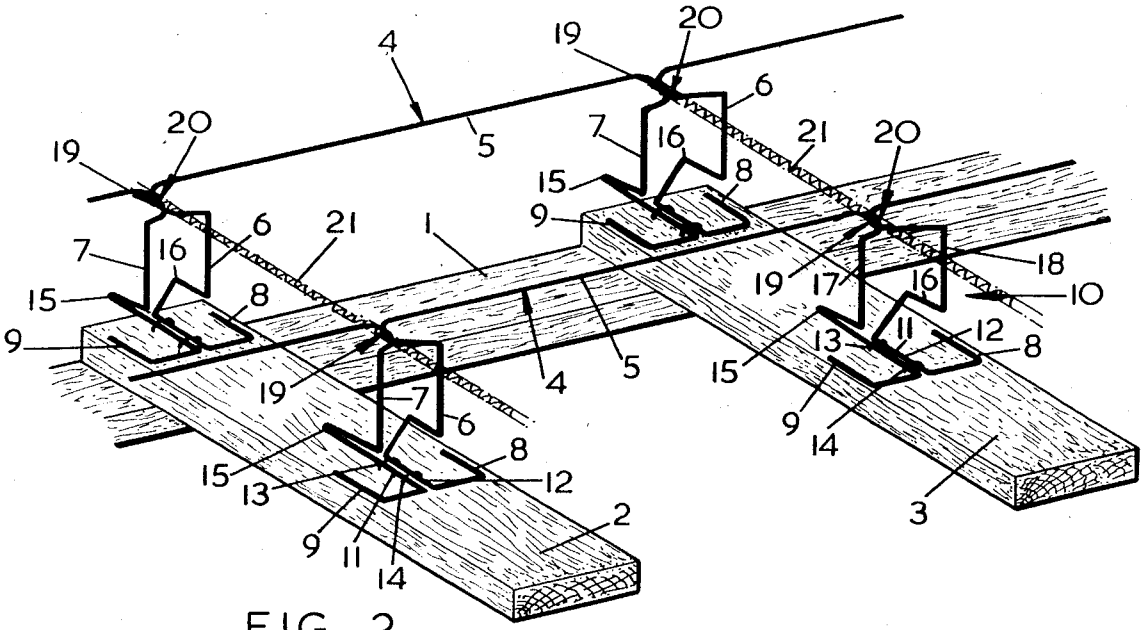
FIG. 2 is a portion of one embodiment of box spring assembly having a deck part as shown in FIG. 1.

Referring now to FIGS. 1 and 2, a first embodiment of box spring assembly comprises a grid-like mattress-supporting deck formed by longitudinally and transversely extending wires supported above a foundation by means of springs. The foundation is a rectangular timber frame of the kind referred to above and only one side rail 1 and two cross rails 2, 3 are illustrated in FIG. 2. The basis of the wire construction carried by the timber frame is a deck element or spring module 4 comprising a single length of wire with an elongate central section 5 terminating in spring legs 6, 7 having feet 8, 9. The modules 4 are arranged in rows with the central sections 5 of the modules of each row aligned with each other to form the longitudinal component of the mattress-supporting deck.

The spring legs 6, 7 of adjacent modules 4 combine to form a spring generally indicated at 10. Each spring 10 has a base constituted by two feet 8, 9 of like U-shape with their adjacent limbs 11, 12 fixed to the respective cross rails 2, 3 by staples 13, 14. The legs 6, 7 have the illustrated configurations with lower bent portion 15, 16 at right angles to each other, and vertical sections 17, 18 serving to limit the spring deflection.

The transition between the legs 6, 7 of the spring 10 and the associated central section 5 is curved into the form of a loop 19, 20. The loops 19, 20 of adjacent modules 4 in a row overlap each other and are united by helicals 21 in the same way as is well known in Bonnell spring units. Each helical extends continuously across the timber frame above a respective cross or end rail to constitute the transverse component of the mattress-supporting deck.

As seen in FIG. 1 the spring modules at one side of the longitudinal centre line of the assembly are oppositely directed compared to those at the other side of the centre line. This arrangement improves the symmetry of the assembly but requires the addition of a continuous longitudinal centre wire 22.

Manufacture is considerably simplified as compared to conventional box spring assemblies. The spring modules 4 are arranged in the required spaced relationship and the top loops 19, 20 are then united by transverse helicals as in Bonnell units. When the assembly is completed the feet of the springs 10 are stapled to the timber frame.

Figure 4:
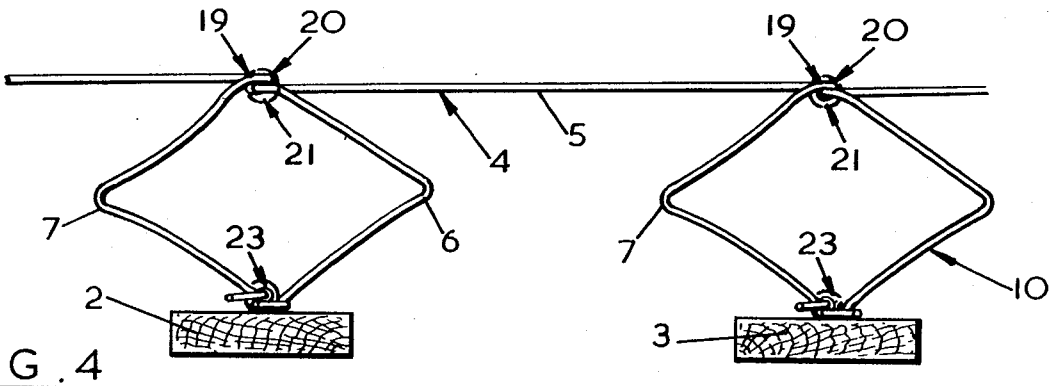
FIG. 4 is a side elevation of the FIG. 3 embodiment.
Figure 5:
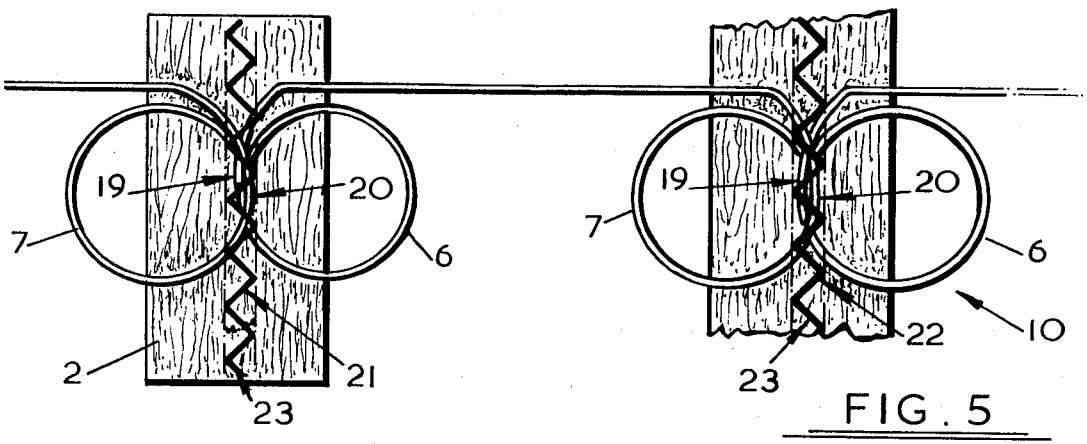
FIG. 5 is a corresponding plan view.

A disadvantage of the first embodiment is that the configuration of the springs 10 does not permit the use of helicals at the base of the assembly. This disadvantage is overcome by employing a coil spring configuration as illustrated in FIGS. 3 to 5 in which like parts are designated by the same reference numerals. In this case the feet 8, 9 of the springs 10 are overlapping loops united by bottom helicals 23. The staples (not shown) used to fix the spring assembly to the frame may be inserted at convenient locations along the bottom helicals 23. It will be observed that in this embodiment there is no limit to the spring deflection in the way afforded by the vertical spring sections 17, 18 of the non-coil springs used in the first embodiment.

Figure 6:
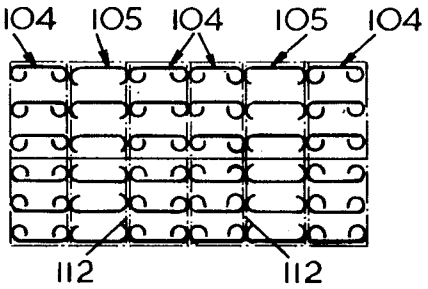
FIGS. 6 to 9 are views corresponding to FIGS. 1, 3, 4 and 5 of a third embodiment of box spring assembly according to the invention.
Figure 8:
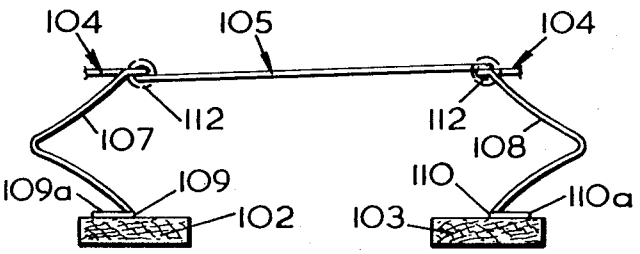
Figure 7:
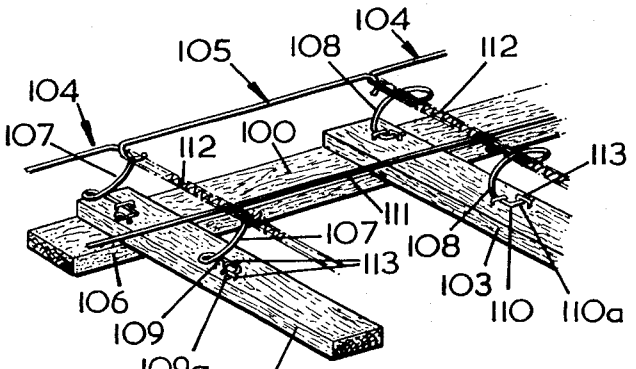
Figure 9:
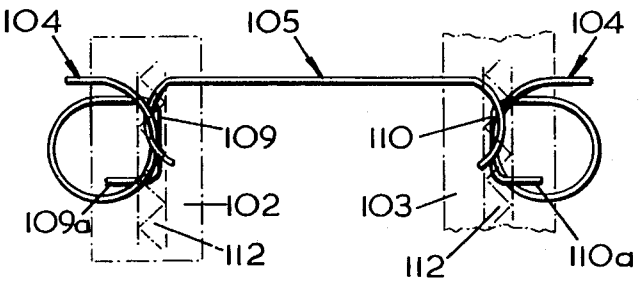

In a third embodiment of the box spring assembly according to the invention, the deck elements comprise spring modules 104 and connecting links 105. Each spring module 104 comprises a single length of wire with an elongate central section 106 terminating in curved sections extending into spring legs 107, 108 having feet 109, 110. Each connecting link 105 is C-shaped with an elongate central section 111 with curved ends. The modules 104 and connecting links 105 are arranged in rows with the central sections 106, 111 thereof aligned with each other to form the longitudinal component of the mattress-supporting deck. The arrangement of FIG. 6 is suitable for a bed that is required to fold in half about a line midway between its ends. Accordingly, the components at either side of the fold line and at the ends of the assembly must be spring modules 104 so as to be supported directly by the timber frame. The penultimate transverse row at each end of the assembly is constituted by connecting links 105.

The curved ends of adjacent components (module/-module or module/link) are united by helicals 112 constituting the transverse component of the mattress-supporting deck, in the same way as described above.

The spring legs 107, 108 of each module 104 are single coils of opposite hand terminating in the feet 109, 110 which are L-shaped with their free end portions or limbs **109*a*, 110*a* directed towards each other in parallel relationship with the central section 106. The feet 109, 110 are fixed to the respective cross rail 102, 103 by means of staples 113** using one or more staples for each limb of each foot.

What is claimed is:

1. A box spring assembly including a foundation and defining a deck for receiving a bedding load, comprising a plurality of deck elements each formed from a single length of wire having an elongate central section terminating in curved sections extending at least in some elements into spring legs, the deck elements being arranged in parallel lengthwise rows with adjacent elements of each row having aligned central sections and adjacent curved sections being secured to each other and to adjacent rows by transverse helical connecting elements, whereby the central sections of the spring elements and the transverse helical connecting elements together form the deck, the deck being supported by the spring legs which are secured at their lower ends to the foundation.

2. An assembly as claimed in claim 1, wherein the foundation comprises an open frame of rectangular shape with parallel longitudinal side rails interconnected by end rails and by cross rails spaced between said end rails, and wherein each of said spring legs is supported on one of said rails.

3. An assembly as claimed in claim 1, wherein the curved sections of adjacent deck elements overlap when united by the helical connecting elements.

4. An assembly as claimed in claim 3, wherein the spring legs are torsion springs with feet which are secured directly to the foundation as by staples.

5. An assembly as claimed in claim 4, wherein the torsion springs include straight vertical portions for limiting the spring deflection.

6. An assembly as claimed in claim 3, wherein the spring legs are coil springs.

7. An assembly as claimed in claim 1, wherein each deck element has two spring legs.

8. An assembly as claimed in claim 7, wherein the spring legs are coil springs and the curved lower ends of the coil springs forming adjacent spring legs are united by lower helical connecting elements in like manner as said curved sections.

9. An assembly as claimed in claim 8, wherein the lower ends of the spring legs are secured to the foundation indirectly by the lower helical connecting elements.

* * * * *